US008210546B2

(12) United States Patent
Köhler

(10) Patent No.: US 8,210,546 B2
(45) Date of Patent: Jul. 3, 2012

(54) TUBE HOLDER FOR A TUBE FILLING MACHINE

(75) Inventor: Bernd Köhler, Karlsruhe (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 1058 days.

(21) Appl. No.: 12/086,303

(22) PCT Filed: Oct. 23, 2007

(86) PCT No.: PCT/EP2007/009158

§ 371 (c)(1),
(2), (4) Date: Jun. 10, 2008

(87) PCT Pub. No.: WO2008/064748

PCT Pub. Date: Jun. 5, 2008

(65) Prior Publication Data

US 2009/0084463 A1 Apr. 2, 2009

(30) Foreign Application Priority Data

Nov. 27, 2006 (DE) ..... 10 2006 055 854

(51) Int. Cl.
*B23B 31/117* (2006.01)
*B65B 3/16* (2006.01)

(52) U.S. Cl. ..... 279/23.1; 279/35; 279/46.7; 279/906; 141/114; 141/313; 141/369

(58) Field of Classification Search ..... 279/23.1, 279/35, 46.1, 46.7, 906; 141/114, 313, 369; *B23B 31/103, 31/117; B65B 3/16*
See application file for complete search history.

(56) References Cited

U.S. PATENT DOCUMENTS

| | | | | |
|---|---|---|---|---|
| 2,012,280 | A * | 8/1935 | Johansen | 279/35 |
| 2,574,157 | A * | 11/1951 | Reichert | 279/66 |
| 3,147,018 | A * | 9/1964 | Reichert | 279/35 |
| 3,199,552 | A | 8/1965 | Warren | |
| 3,390,891 | A | 7/1968 | Stichhan | |
| 3,819,194 | A * | 6/1974 | Grevich et al. | 279/23.1 |

FOREIGN PATENT DOCUMENTS

| | | | |
|---|---|---|---|
| DE | 11 93 862 | | 5/1965 |
| DE | 2608819 | A * | 12/1976 |
| JP | 082 17 023 | | 8/1996 |

* cited by examiner

*Primary Examiner* — Eric A Gates
(74) *Attorney, Agent, or Firm* — Paul Vincent

(57) ABSTRACT

A tube holder for a tube filling machine includes a cup-shaped housing having a tube receptacle that opens towards the top and into which one end area of a tube can be inserted. At least one vertical groove is formed in the area of the inner wall of the tube receptacle into which a clamping element is inserted, wherein the clamping element can be radially displaced substantially perpendicularly to the longitudinal central axis of the tube receptacle and is pivotably disposed about a pivot axis that extends substantially tangentially relative to the inner wall of the tube receptacle. A clamping force that acts radially from the outside onto the inserted tube can be applied by the clamping element under the action of upper and lower spring elements. The pivot axis is thereby formed on a pivot bearing which permits radial displacement of the pivot axis.

9 Claims, 2 Drawing Sheets

TUBE HOLDER FOR A TUBE FILLING MACHINE

This application is the national stage of PCT/EP2007/009158 filed on Oct. 23, 2007 and also claims Paris Convention priority of DE 10 2006 055 854.5 filed Nov. 27, 2006.

BACKGROUND OF THE INVENTION

The invention concerns a tube holder for a tube filling machine, comprising a cup-shaped housing having a tube receptacle that opens towards the top and into which one end area of a tube can be inserted, wherein at least one vertical groove is formed in the area of the inner wall of the tube receptacle, into which a clamping element is inserted, wherein the clamping element can be radially displaced substantially perpendicularly with respect to the longitudinal central axis L of the tube receptacle, and is disposed to be pivotable about a pivot axis that extends substantially tangentially to the inner wall of the tube receptacle, wherein a clamping force that acts in a radial direction from the outside onto the inserted tube can be applied by the clamping element under the action of at least one spring element, wherein the clamping element has an upper first section which is disposed on the side of the pivot axis facing the opening of the tube receptacle above the pivot axis, and a lower second section which is disposed on the side of the pivot axis facing away from the opening of the tube receptacle below the pivot axis.

A tube filling machine of conventional construction has an endlessly revolving conveying device that carries a plurality of receptacles, into each of which one tube holder is inserted. The head or cap section of one tube can be inserted from the top into each tube holder, wherein the tube runs through the individual working stations of the tube filling machine together with the tube holder. In certain working stations, e.g. the filling station and the closing station, the tube including tube holder may be lifted out of the receptacle and inserted into the respective working station, wherein it is lowered again into the receptacle after termination of the working step. The filled and closed tube is removed from the tube holder in a removing station and transported away.

A tube holder in accordance with the German patent 1 173 862 comprises a cup-shaped housing with a tube receptacle which opens towards the top and into which the head or cap section of a tube, which preferably consists of plastic material or metal, is inserted. Several vertical slots are formed in the inner wall of the tube receptacle, which are distributed about the periphery of the tube wall. One clamping element is loosely fitted into each slot which is under the action of an outer spring element. Each clamping element is floatingly disposed and can therefore be adjusted perpendicularly with respect to the longitudinal central axis of the tube receptacle, and is loaded by the spring element in a radially inward direction towards the longitudinal central axis of the tube receptacle. When a tube is inserted into the tube receptacle, the tube urges the clamping elements in a radially outward direction against the respective spring force. The reaction force urges the clamping elements from the outside in a radial direction against the outer wall of the tube, thereby fixedly clamping the tube in the tube receptacle.

The terms "upper" and "lower" used in this description refer to the normal orientation of a tube holder with a tube receptacle that opens towards the top and into which the head or cap section of the tube can be inserted from the top, such that the end of the tube to be closed projects past the tube holder on the upper side. When the tube holder is oriented in this fashion, its longitudinal central axis extends in a vertical direction and the clamping elements are radially displaced in a direction perpendicular thereto, i.e. substantially horizontal.

The tubes change their geometrical shapes during passage through the tube filling machine. An empty, still unclosed tube has a cylindrical, in particular circular cylindrical, tube body. When the tube has been filled, it is closed. A plastic tube is closed by compressing the end of the tube facing away from the tube holder using closing jaws and welding it, thereby forming a linear weld seam that usually extends perpendicularly to the longitudinal axis of the tube. A metal tube is closed by compressing the end of the tube that faces away from the tube holder and folding the compressed tube end several times. The following example is based on a welded plastic tube. The invention is, however, not limited thereto.

When the tube is closed, it obtains a rotationally asymmetrical shape. As viewed from a direction perpendicular to the weld seam, the tube has a shape that diverges upwardly towards the end that comprises that weld seam. As viewed from a direction perpendicular thereto, the tube has a shape that converges towards the weld seam.

In order to adjust the orientation of the clamping elements to the tube shape in the respective peripheral tube area, the clamping elements in accordance with DE 1 193 862 are disposed to be freely floating, which permits pivoting of the clamping elements about a pivot axis that extends substantially tangentially relative to the inner tube wall of the tube receptacle. This is, however, disadvantageous in that the position of the pivot axis is not exactly defined but may be displaced in dependence on the position of the clamping element relative to the tube holder and also in dependence on the tube shape, such that retention of the tube in the tube holder cannot be exactly reproduced. Moreover, retention of the tube in the surface or peripheral areas that converge to the upper tube end in accordance with the tube holder of DE 1 193 862 is highly inadequate.

It is the underlying purpose of the invention to provide a tube holder of the above-mentioned type which reliably holds all peripheral areas of both an empty tube as well as a closed tube.

SUMMARY OF THE INVENTION

This object is achieved in accordance with the invention with a tube holder comprising the features of the independent claim.

In accordance with the inventive tube holder, the clamping element can be conventionally displaced substantially radially with respect to the longitudinal central axis of the tube receptacle against or in consequence of the spring force, and thus be clamped to the outer surface of an inserted tube. In addition, the clamping element can be pivoted about a horizontal pivot axis that extends substantially tangentially with respect to the inner wall of the tube receptacle or parallel thereto, wherein the pivot axis is formed on a defined pivot bearing which permits radial displacement of the pivot axis but prevents displacement of the pivot bearing towards the longitudinal central axis of the tube receptacle. The clamping element is therefore not disposed to be freely floating but can be pivoted about a defined pivot bearing which can be adjusted only in a radial direction, thereby ensuring that the clamping element can be automatically adjusted to the shape of the tube surface, in particular, when the tube is closed, such that the clamping element abuts the tube surface with its entire surface. Full-surface abutment of the clamping element on the tube surface provides reliable retention of the tube in spite of relatively small clamping forces.

The pivot axis of the clamping element extends perpendicularly to the longitudinal central axis of the tube receptacle and also perpendicularly with respect to the radial displacement motion of the clamping element against or in response to the spring force. The pivot axis is disposed in a central area of the clamping element. The clamping element therefore has an upper first section which is disposed on the side of the pivot axis facing the opening of the tube receptacle above the pivot axis, and a lower second section which is disposed on the side of the pivot axis facing away from the opening of the tube wall below the pivot axis. The clamping element is subjected to the action of at least two spring elements, wherein at least one first spring element acts on the upper first section of the clamping element and at least one second spring element acts on the lower second section of the clamping element. In a further development of the invention, the clamping element may be pivotable about the pivot bearing in such a fashion that its upper first section can be pivoted both into a radially outwardly inclined position and also into a radially inwardly inclined position. The clamping element should thereby be freely rotatable about the pivot bearing, i.e. the pivot motion of the clamping element should not be impaired by stops etc. In this fashion, it is ensured that the overall surface of the clamping element can evenly seat against any geometrical shape of a closed tube, i.e. in particular outwardly inclined surface areas as well as inwardly inclined surfaces areas.

In a particularly advantageous embodiment of the invention, the spring force that the lower second spring element exerts onto the clamping element is larger than the spring force that the upper first spring element exerts onto the clamping element. Due to the larger lower spring force in this embodiment, the upper ends of the clamping elements that face the opening of the tube receptacle are disposed at a larger radial outer distance prior to insertion of a tube than their lower ends at which they are urged in a radial inward direction by the larger spring force. The clamping elements thereby form a type of funnel that facilitates insertion of the tube.

An unclosed tube has a circular cylindrical tube body, at the lower end of which an outlet connection is formed via a so-called tube shoulder. A closing lid or a cap can be disposed onto the outlet connection. Due to the geometrical relationships, the tube shoulder is substantially more resistant to deformation in a radial inward direction compared e.g. to the center of the tube body. This is utilized in accordance with the invention by the different spring forces exerted by the first and second spring elements for holding the tube. When the empty tube is inserted into the tube receptacle, the tube shoulder initially passes the upper first section of the clamping elements, and then their pivot axes, and urges the clamping elements in the lower second section in a radial outward direction, where the larger spring forces act. In consequence thereof, relative large reaction forces act on the tube shoulder, which reliably fix the tube in the tube holder. The pivoting motion of the clamping elements during insertion of the tube also causes the upper first sections of the clamping elements, which are loaded by the smaller spring force, to abut the outer side of the wall of the tube body.

The pivot axis of the clamping element is designed in such a fashion that it is radially displaced with the pivot element upon radial displacement of the latter, wherein the pivot motion of the clamping elements and their radial displacement are decoupled.

In order to ensure adequate retention of the tube within the tube holder, several clamping elements should preferably be uniformly distributed over the periphery of the inner wall of the tube receptacle. Provision of an uneven number of clamping elements for the tube holder has turned out to be advantageous: in particular preferably 3, 5 or 7 clamping elements.

In a preferred embodiment of the invention, the clamping element, which preferably consists of plastic material or metal, is shaped as a bracket and comprises a strip-shaped, preferably flat, contact surface, in particular, on its inner side that faces the longitudinal central axis of the tube receptacle. The strip-shaped contact surface preferably extends substantially vertically, i.e. abuts an inserted tube along its longitudinal direction.

In a preferred embodiment of the invention, all clamping elements have common spring elements, which can be achieved, in particular, in that the spring elements are snap rings, which preferably extend around the circumference of the tube holder housing.

Further details and features of the invention can be extracted from the following description of an embodiment with reference to the drawing.

DESCRIPTION OF THE PREFERRED EMBODIMENT

Figure 1:
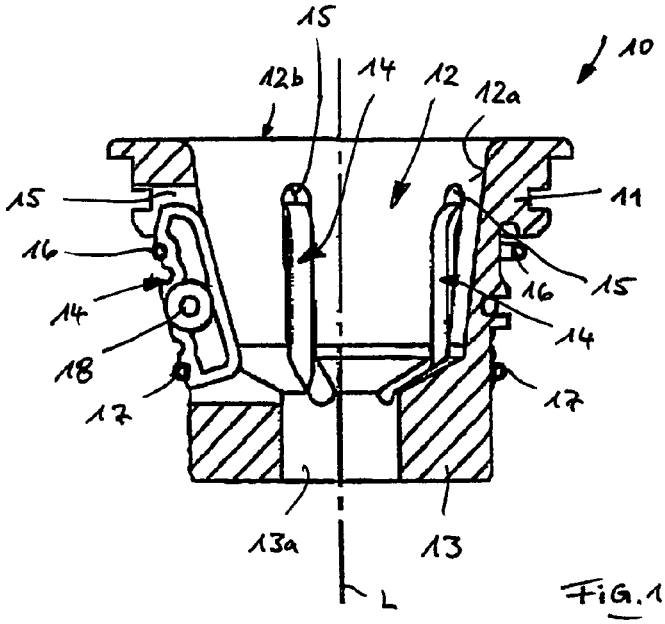
FIG. 1 shows a vertical section through an inventive tube holder.

In accordance with FIG. 1, a tube holder 10 has a cup-shaped housing 11 that preferably consists of plastic material and contains an interior tube receptacle 12 that opens towards the top and is joined by a receptacle for a head or cap section $T_2$ of a tube T (FIG. 3) at the lower end in the bottom 13 of the housing 11. The tube receptacle 12 has a cross-section that slightly tapers from its upper opening 12*b* in order to facilitate insertion of the tube T.

Several vertical slot-shaped grooves 15 are formed in the inner wall 12*a* of the tube receptacle 12, which are distributed over the periphery and extend just above the bottom 13 of the housing 11. The grooves 15 completely penetrate the walls of the housing 11.

A bracket-shaped clamping element 14 is disposed in each groove 15, which has a flat, strip-shaped contact surface 14*a* on its side facing the tube receptacle 12 or its vertical longitudinal central axis L. Each clamping element 14 is disposed on the wall of the associated groove 15, and thereby on the tube receptacle 12, via a pivot bearing 20. The pivot bearing 20 defines a pivot axis 18 which extends horizontally and substantially tangentially relative to the inner wall 12*a* of the tube receptacle 12. The clamping element 14 can thereby be pivoted about the pivot axis 18 in correspondence with the double arrow S. The pivot bearing 20 is designed in such a fashion that the pivot axis 18 can be displaced perpendicularly to the longitudinal central axis L of the tube receptacle 12 and thus in a radial direction, as is indicated by the double arrow H shown in FIG. 2. The pivot axis 18 is disposed in the central area of the clamping element 14, such that the clamping element 14 comprises an upper first section 14.1, which is disposed on the side of the pivot axis 18 facing the opening 12*b* of the tube receptacle 12, and a lower second section 14.2, which is disposed on the side of the pivot axis 18 facing away from the opening 12*b* of the tube receptacle 12.

Figure 2:
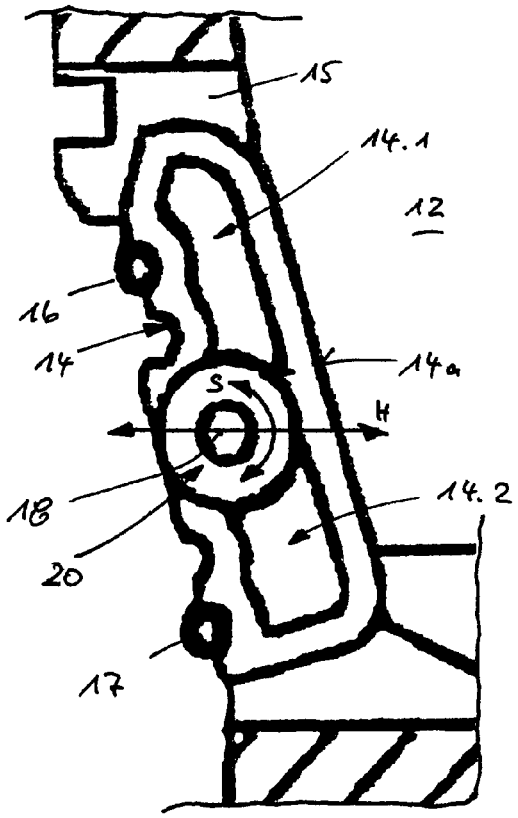
FIG. 2 shows an enlarged view of a section of the tube holder in accordance with FIG. 1.

A first spring element 16 in the form of a snap ring is disposed on the outer side of the housing 11, which abuts all clamping elements 14 in the upper first section 14.1 and loads the clamping elements 14 with a first spring force that acts in a radial inward direction towards the longitudinal central axis L. A second spring element 17 in the form of a circumferential snap ring is similarly provided, which acts on the clamping elements 14 in the respective lower second section 14.2 and loads the clamping elements with a second spring force that acts in a radially inward direction towards the longitudinal central axis L. The second spring force exerted by the second spring element 17 is thereby larger than the first spring force exerted by the first spring element 16. In consequence thereof, the clamping elements 14 are disposed at an inclination in the unused state of the tube holder 10, as is shown in FIGS. 1 and 2, in that the lower second section 14.2 is radially inwardly withdrawn due to the larger second spring force, and correspondingly the upper first section 14.1 is radially outwardly pivoted, with its upper end being, in particular, completely received in the respective groove 15. Insertion of the tube T is thereby facilitated and interlocking of the tube shoulder $T_3$ at the upper end of the pivot elements 14 is prevented.

Figures 3, 4, 5:
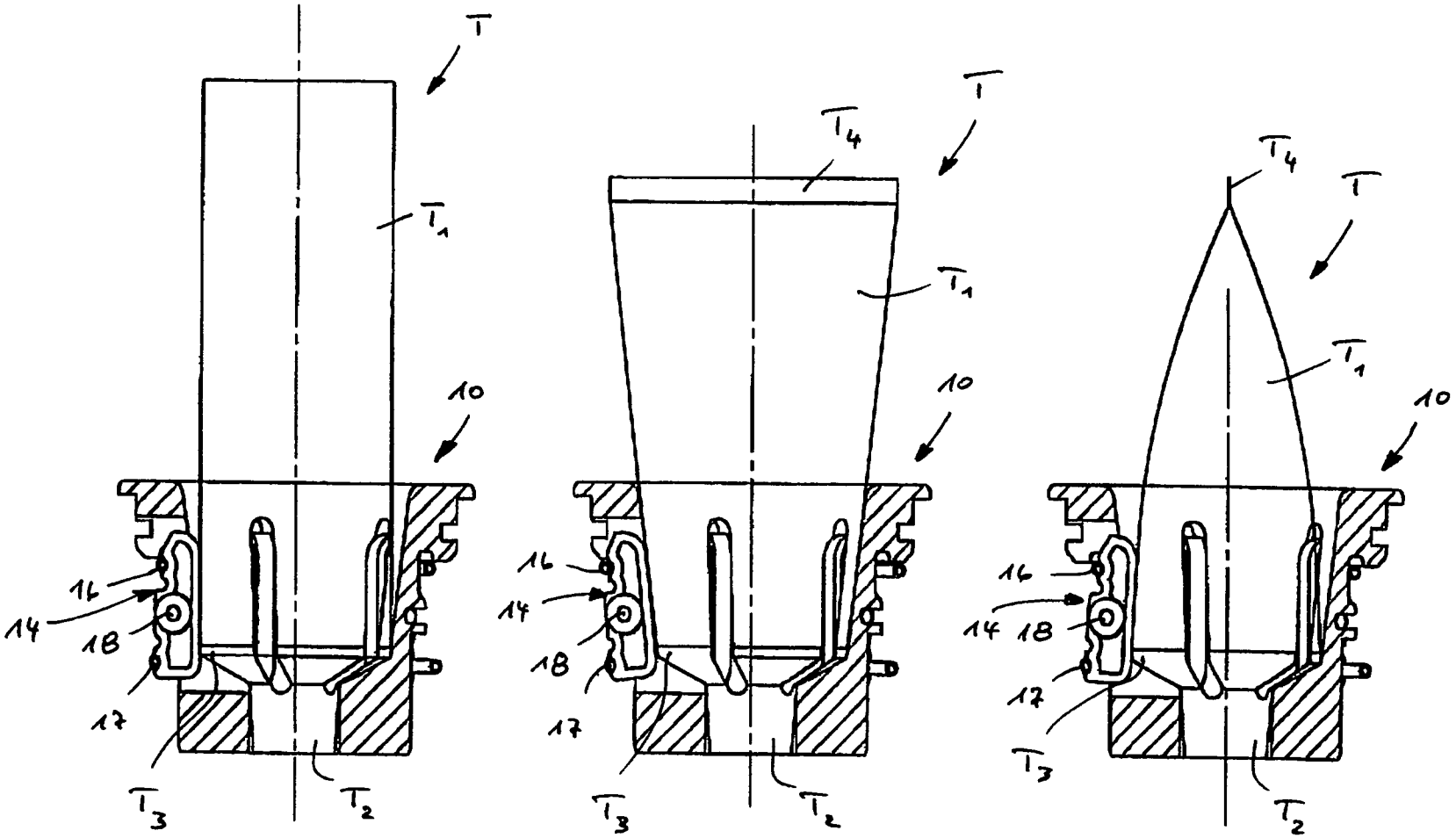
FIG. 3 shows the tube holder in accordance with FIG. 1 with inserted unclosed tube.
FIG. 4 shows the tube holder according to FIG. 3 after closing the tube, viewed perpendicularly to the weld seam of the tube.
FIG. 5 shows a view of the tube holder corresponding to FIG. 4 in the longitudinal direction of the weld seam of the tube.

As is shown in FIG. 3, an unclosed tube T normally has a circular cylindrical tube body $T_1$ which is connected to a head or cap section $T_2$ via a tube shoulder $T_3$. For inserting the empty unclosed tube T into the tube holder 10, the lower head or cap section $T_2$ of the tube T is inserted through the opening 12*b* into the tube receptacle 12, wherein the tube shoulder $T_3$ comes into abutment with the contact surfaces 14*a* of the clamping elements 14 and urges the clamping elements, in a radially outward direction, against the spring forces of the spring elements 16, 17. At the same time, the clamping elements 14 pivot about their respective pivot axes 18, such that the full contact surface 14*a* of each clamping element 14 abuts the outer side of the tube T. The insertion motion of the tube T is continued until the head or cap section $T_2$ is received in the receptacle 13*a* in the bottom 13 of the housing 11 with tight fit.

Since the lateral surface of the tube body $T_1$ of the unclosed tube T (FIG. 3) extends in a substantially vertical direction, the clamping elements 14 are also substantially vertically oriented. The upper first spring element 16 clamps the upper first section 14.1 of the clamping element 14 in a radial direction against the outer side of the tube body $T_1$, and the second spring element 17 radially clamps the lower second section 14.2, with a larger clamping force, from the outside against the tube shoulder $T_3$. Since the tube shoulder $T_3$ is relatively resistant to deformation in a radial inward direction, the tube T can be reliably held in the tube receptacle 12 due to the increased second spring force of the second spring element 17.

When the tube T has been filled, it is closed at its upper end facing away from the tube holder 10 by forming a weld seam $T_4$ which usually extends perpendicularly to the longitudinal direction of the tube T. This changes the shape of the tube, as is shown in FIGS. 4 and 5. FIG. 4 shows a side view of the tube T perpendicularly to the longitudinal direction of the weld seam $T_4$. In this view, the tube T has a shape that diverges towards its upper end comprising the weld seam $T_4$. In the view of FIG. 5, which is perpendicular thereto, the tube T has a shape that converges towards the weld seam $T_4$. The clamping elements 14 can follow these tube wall shape variations by pivoting about the respective pivot axis 18. As is shown in FIGS. 4 and 5, the entire surface of the clamping elements 14 is in abutment both in the tube surface areas that are inclined in an outward direction (FIG. 4) and also in the tube surface areas that are inclined in an inward direction (FIG. 5), such that the tube T is reliably held.

The tube T is removed by withdrawing it from the tube receptacle 12, which is followed by a return motion, caused by the spring forces, of the clamping elements 14 into the position of FIG. 1, such that a new tube can be inserted.

I claim:

1. A tube holder for a tube filling machine, the holder comprising:

a cup-shaped housing defining a tube receptacle, said tube receptacle having an opening towards a top of said housing into which one end area of a tube can be inserted, wherein an inner wall of said housing proximate said tube receptacle has at least one vertical groove;

a pivot bearing having a pivot axis extending substantially tangentially to said inner wall of said tube receptacle, said pivot bearing cooperating with said housing for radial displacement of said pivot bearing relative to said housing;

at least one clamping element mounted to said pivot bearing and inserted into said vertical groove such that said clamping element can be radially displaced substantially perpendicularly with respect to a longitudinal central axis of said tube receptacle and pivotable about said pivot axis, said clamping element having a first upper section which is disposed on a side of said pivot axis facing said opening of said tube receptacle, above said pivot axis, and a lower second section which is disposed on a side of said pivot axis facing away from said opening of said tube receptacle, below said pivot axis;

at least one first spring element cooperating with said housing and said upper first section of said clamping element to urge said upper section of said clamping element in a substantially radial direction towards a tube inserted in said clamping receptacle; and at least one second spring element cooperating with said housing and said lower second section of said clamping element to urge said lower section of said clamping element in a substantially radial direction towards the tube inserted in said clamping receptacle.

2. The tube holder of claim 1, wherein said clamping element can be pivoted about said pivot bearing in such a fashion that said upper first section can be pivoted both into a radially outwardly inclined position and also into a radially inwardly inclined position.

3. The tube holder of claim 1, wherein a spring force that said second spring element exerts on said clamping element is larger than a spring force that said first spring element exerts on said clamping element.

4. The tube holder of claim 1, wherein several clamping elements are distributed over a periphery of said inner wall of said tube receptacle.

5. The tube holder of claim 4, wherein an odd number of clamping elements are provided.

6. The tube holder of claim 1, wherein said clamping element has a bracket shape.

7. The tube holder of claim 1, wherein said clamping element has a strip-shaped contact surface.

8. The tube holder of claim 7, wherein said strip-shaped contact surface extends in a substantially vertical direction.

9. The tube holder of claim 1, wherein said first and said second spring elements are snap rings which extend around a periphery of said housing.

* * * * *